US005653129A

United States Patent [19]

Jang

[11] Patent Number: 5,653,129

[45] Date of Patent: Aug. 5, 1997

[54] WASHING MACHINE WITH A BUBBLE GENERATOR

[75] Inventor: Byung-Kew Jang, Kyeonggi-do, Rep. of Korea

[73] Assignee: Daewoo Electronics Co., Ltd., Seoul, Rep. of Korea

[21] Appl. No.: 596,758

[22] Filed: Feb. 5, 1996

[30] Foreign Application Priority Data

Mar. 31, 1995 [KR] Rep. of Korea ..... 95-6448 U
Apr. 29, 1995 [KR] Rep. of Korea ..... 95-9057 U

[51] Int. Cl.[6] ..... D06F 17/00; D06F 18/00; D06F 39/02

[52] U.S. Cl. ..... 68/13 R; 68/20; 68/183; 261/124; 261/DIG. 42

[58] Field of Search ..... 68/4, 13 R, 20, 68/183; 261/124, DIG. 42, DIG. 47

[56] References Cited

U.S. PATENT DOCUMENTS 1,768,702 7/1930 Martin ..... 68/183 X
1,898,676 2/1933 Magnus ..... 68/183
2,535,901 12/1950 Cole ..... 68/183
3,418,832 12/1968 Valdespino ..... 68/183
5,220,813 6/1993 Chen et al. ..... 68/183 X

FOREIGN PATENT DOCUMENTS 0495168 11/1991 European Pat. Off. .
1273382 9/1961 France .
813550 9/1951 Germany .
3042832 6/1982 Germany ..... 68/183
257386 10/1948 Switzerland .

*Primary Examiner*—Philip R. Coe
*Attorney, Agent, or Firm*—Beveridge, DeGrandi, Weilacher & Young LLP

[57] ABSTRACT

Disclosed is a washing machine having a bubble feeding device installed at the inner surface of a door of the top of a washing body for feeding air bubbles into a rotatable tub to the top of a washer body. The bubble feeding device comprises a telescopic pipe and a drive device for driving the pipe. The drive device includes a motor and first and second pulleys operatively connected to the motor. The second pulley has gear teeth formed on its circumference and a flexible string having a train of teeth is wound on the second pulley to mesh the train of teeth with the gear teeth. The flexible string extends into an inner telescopic pipe coaxially installed within the telescopic pipe and the end of the string is fixed to the lower end of the inner pipe.

10 Claims, 4 Drawing Sheets

WASHING MACHINE WITH A BUBBLE GENERATOR

BACKGROUND OF THE INVENTION

1. Field of the Invention

The present invention relates to a washing machine, and more particularly to a washing machine having an air bubble generator which comprises a telescopic pipe installed on an inner surface of a door to supply air through the telescopic pipe.

2. Description of the Prior Art

Generally, washing machines are classified into a vortex-type washer and a drum-type washer by means of their washing manner. In a vortex-type washer, laundry articles are subject to a washing action as a pulsator therein rotates to generate a vortex flow within a washer tub. Such a vortex-type washer encompasses, in a broad sense, a stirrer-type washer wherein laundry articles are made to undergo a vigorous friction movement in washing water by means of a bladed stirrer. A drum-type washer has a horizontal rotary drum partially submerged in the washing water. With this type of washer, the laundry articles contained in the rotary drum are rubbed with each other as the drum rotates around its horizontal axis.

These prior art washers have proven to be poor in their overall cleaning efficiency, mainly because they are not able to dissolve the detergent efficiently and to apply a sufficient intensity of physical force to the laundry articles. Although it may be possible for a vortex-type washer to enhance the cleaning efficiency by further increasing the rotational speed of the pulsator or stirrer and thereby creating a more intensive vortex in the washer tub, this would give rise to another disadvantage that the laundry articles tend to suffer a severe damage as the washing operation continues. In order to remove the problems encountered in these washers, there have been proposed a variety of "bubble washers" using air bubbles.

In FIG. 1, an overall structure of a prior art bubble washer is shown. The prior art bubble washer comprises a stationary washer tub 10 capable of containing a level of washing fluid, a rotatable washer tub 14 having a plurality of fluid communication holes 12 formed at its side wall and installed coaxially with stationary washer tub 10, a pulsator 16 rotatably mounted on the bottom of rotatable washer tub 14 for creating a vortex flow therein, a driving part 22 having a motor 18 and a clutch assembly 20 for driving rotatable washer tub 14 and pulsator 16, and a bubble generator 26 installed at the bottom of stationary washer tub 10 for supplying air bubbles into rotatable washer tub 14 through bubble passages 24 formed at the bottom of stationary washer tub 14.

Bubble generator 26 is connected through an air conduit 27 with an air pump 30 adjacent to a controller 28. When air pump 30 operates in response to an operational signal from controller 28, a volume of air is supplied to bubble generator 26 through air conduit 27 to generate air bubbles.

The air bubbles generated from bubble generator 26 are supplied under pulsator 16 through bubble passages 24. Then, the air bubbles are supplied to rotatable washer tub 14 through a plurality of holes and grooves radially provided for pulsator 16.

Because the bubble generator is mounted on the bottom surface of the stationary washer tub in a conventional bubble washer, a large portion of generated air bubbles come in contact with laundry articles located only at the lower part of the stationary washer tub. In other words, the air bubbles are not provided for the entire laundry articles in uniform state, which may result in uneven laundering according to the amount and kind of laundry articles. Therefore, the development of a bubble washer in which air bubbles are uniformly distributed to the laundry articles has been required.

SUMMARY OF THE INVENTION

The present invention is devised to solve the foregoing problems. It is an object of the present invention to provide an enhanced bubble washing machine capable of uniform distribution of air bubbles to laundry articles for even washing.

Another object of the present invention is to provide a bubble washing machine in which ozone is utilized to remove bacteria inhabiting laundry articles.

Still another object of the present invention is to provide a bubble washing machine having the enhanced dry efficiency by uniformly feeding a hot air stream to laundry articles.

To achieve the above objects of the present invention, there is a washing machine comprising,

- a stationary washer tub capable of containing a level of washing fluid;
- a rotatable washer tub for receiving laundry articles, the rotatable washer tub having a plurality of fluid communication holes formed at its side wall and installed within the stationary washer tub;
- a pulsator rotatably mounted on the bottom of the rotatable washer tub for creating a vortex flow therein;
- drive means for generating the force for driving the rotatable washer tub and the pulsator;
- expansible bubble feeding means installed at, toward the rotatable washer tub, a door provided for the top of a washer body, the bubble feeding means being expanded into the rotatable washer tub if the feeding of air bubbles is required for the rotatable washer tub and being withdrawn out of the rotatable washer tub if the feeding thereof is not required; and
- pneumatic generating means connected to the bubble feeding means through an air conduit for supplying air to the bubble feeding means.

Preferably, bubble feeding means comprises a telescopic pipe coaxially installed at the rotatable washer tub and capable of expanding axially, and pipe drive means for driving the telescopic pipe.

For instance, the telescopic pipe is provided with, at its lowest stage, a plurality of blow-out holes through which an air stream is fed into the rotatable washer tub to create air bubbles.

The pipe drive means may comprise,

- a motor for generating the driving force to expand/withdraw the telescopic pipe;
- a first pulley operatively connected with the motor;
- a second pulley having, at its outer circumference, a groove for a belt and gear teeth and operatively connected with the first pulley through the belt;
- an inner telescopic pipe coaxially installed within the telescopic pipe, a lower end of the inner telescopic pipe being fixed to a lower end of the telescopic pipe; and
- a flexible string having a train of teeth meshed with the gear teeth, wound on the second pulley to mesh with the gear teeth and extending through the inner telescopic pipe to fix an end thereof to the lower end of the inner telescopic pipe.

The air conduit is communicated with the inside of the telescopic pipe so that an air stream may flow from the air conduit through a space between the telescopic pipe and the inner telescopic pipe and blows out into the rotatable washer tub through the blow-out holes to create air bubbles.

BRIEF DESCRIPTION OF THE DRAWINGS

The above objects and other advantages of the present invention will become more apparent by describing in detail preferred embodiment thereof with reference to the attached drawings in which.

DETAILED DESCRIPTION OF THE PREFERRED EMBODIMENT

Figure 3:
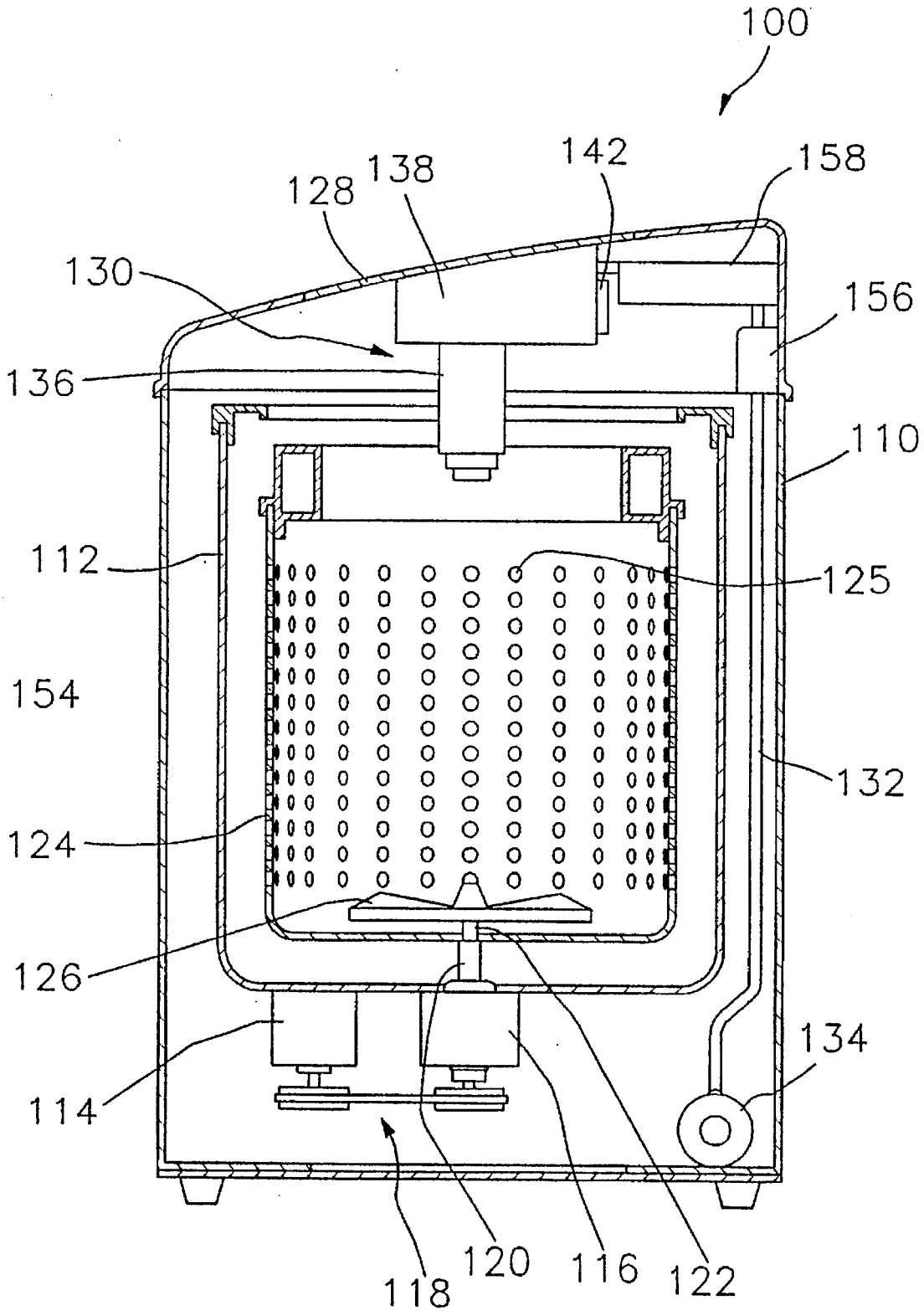
FIG. 3 is a schematic sectional view of a vortex-type bubble washing machine according to the present invention under the condition that a telescopic pipe ascends within a washer tub.
Figure 4:
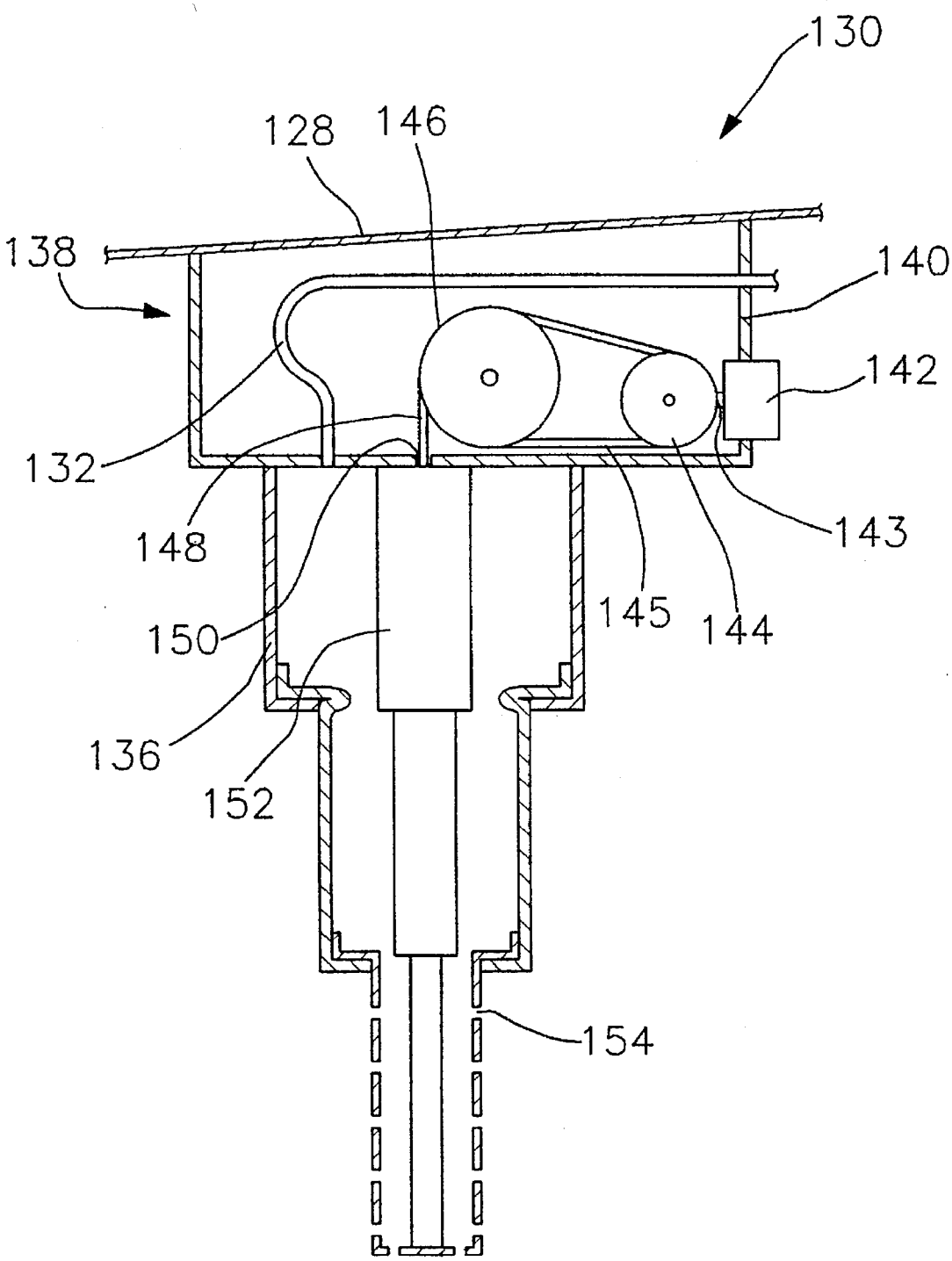
FIG. 4 is a sectional view of an example of telescopic bubble feeding means employed in the present invention.

Hereinafter, the preferred embodiment of the present invention will be described in detail with reference to FIGS. 2, 3 and 4.

Figure 1:
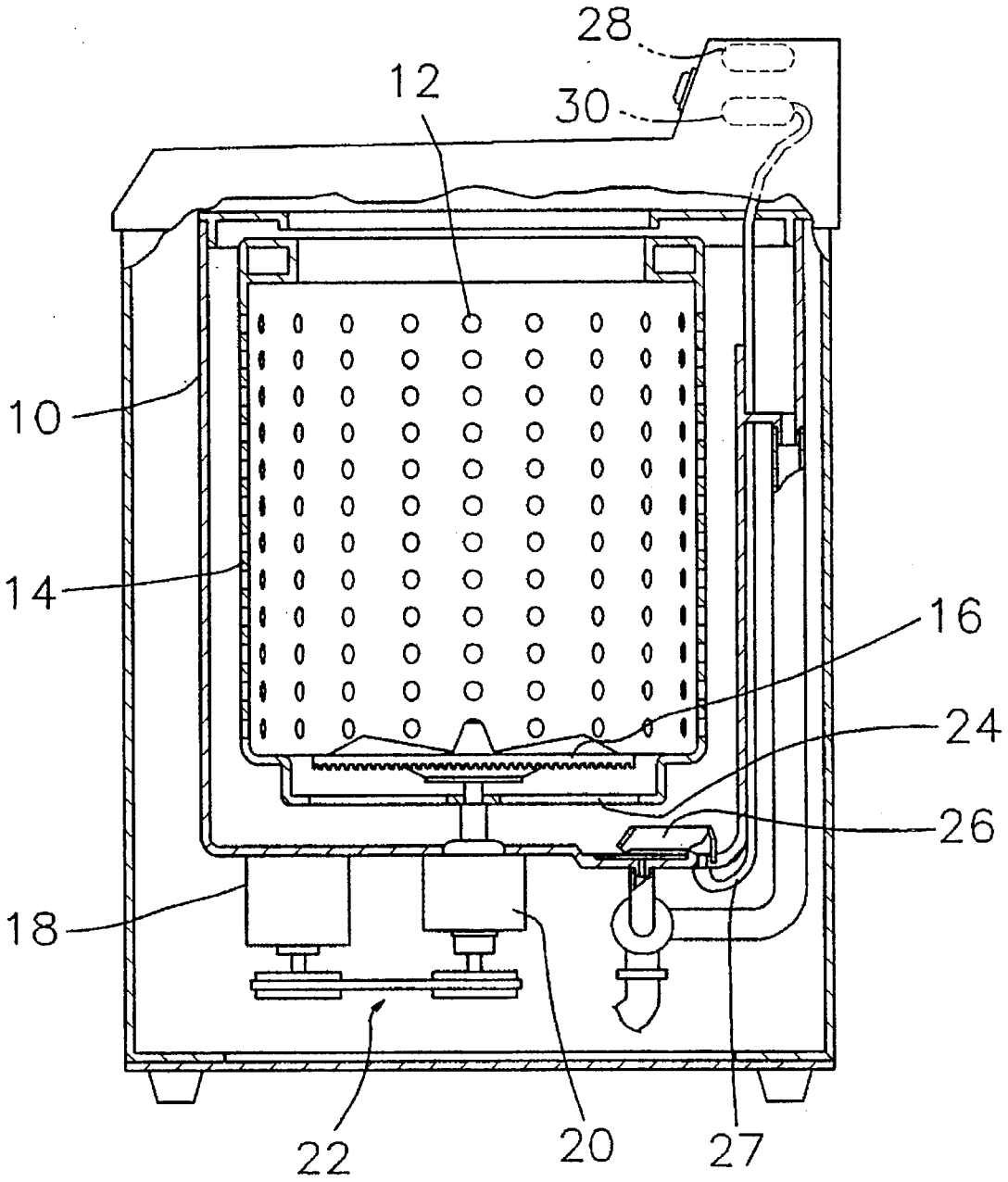
FIG. 1 (PRIOR ART)
FIG. 1 is a schematic sectional view of a conventional vortex-type bubble washing machine showing its overall construction.
Figure 2:
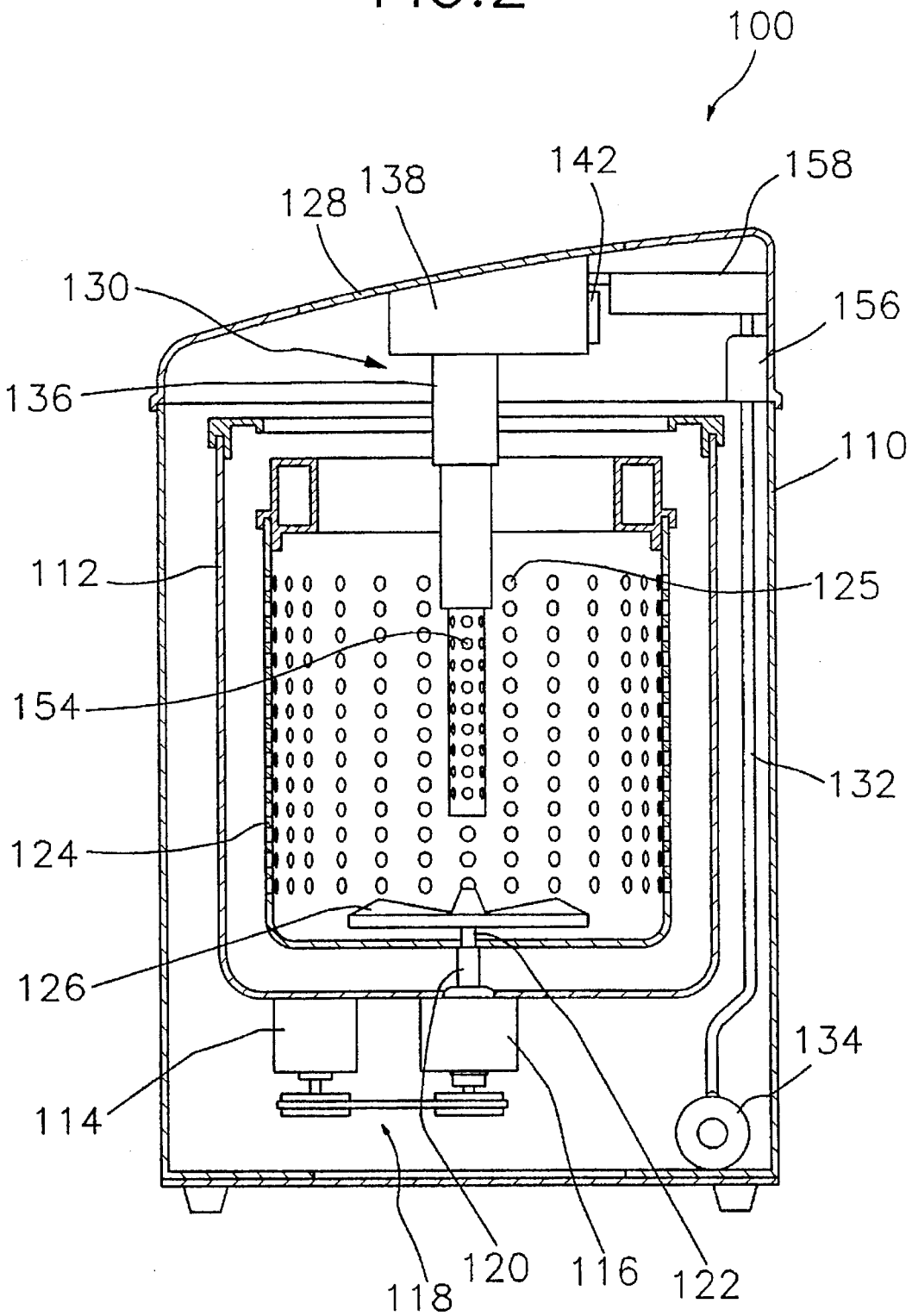
FIG. 2 is a schematic sectional view of a vortex-type bubble washing machine according to the present invention under the condition that a telescopic pipe descends within a washer tub.

Referring to FIG. 2, there is shown an embodiment of a washing machine 100 according to the present invention. Washing machine 100 comprises a housing 110 and a stationary washer tub 112 fixedly mounted within housing 110 for containing a level of washing fluid therein. Although not shown, a drain pipe through which the washing fluid flows out of stationary tub 112 is connected to the bottom of stationary tub 112. An electric motor 114 and a clutch assembly 116 are secured to the outer bottom surface of stationary tub 112. Electric motor 114 and clutch assembly 116 are operatively connected to each other through a belt transmission mechanism 118. Clutch assembly 116 has first and second driven shafts 120 and 122 and serves to selectively transmit the driving force generated by electric motor 114 to one of first and second driven shafts 120 and 122.

A rotatable washer tub 124 is secured to the top end of first driven shaft 120 which carries rotatable tub 124. Rotatable tub 124 is provided with, at its side wall, a plurality of fluid communication holes 125 through which the water fluid flows into or out of rotatable tub 124. Rotatable tub 124 is kept immovable during the washing process and rotates during the dehydrating process so that the water contained in the laundry articles flows out of rotatable tub 124 through fluid communication holes 125 and drains through the drain pipe.

Second driven shaft 122 extends into rotatable tub 124 and a pulsator 126 is secured to the top end of second driven shaft 122. Pulsator 124 is rotatable in a forward or reverse direction to create a vortex flow within rotatable tub 124.

The upside of washing machine 100 is provided with a door 128 for loading and unloading the laundry articles. Bubble feeding means 130 is mounted on the inner surface of door 128 to extend toward rotatable tub 124. Bubble feeding means 130 is shown in FIG. 4 in detail. An air pump 134 is communicated with bubble feeding means 130 through an air conduit 132. In the drawings, air pump 134 is installed at the bottom plate of washing machine 100 but may be installed at any other suitable place.

Bubble feeding means 130 comprises a telescopic pipe 136 which is movable upward and downward, and driving means 138 for actuating telescopic pipe 136. Though 3-stage telescopic pipe 136 is shown in the drawings, the number of stages is not especially limited as long as the washing machine operates smoothly.

Telescopic pipe 136 is fixed to a casing 140 of driving means 138 coaxially with rotatable tub 124. Casing 140 is fixed to the inner surface of door 128 and a DC motor 142 is installed to casing 140. A driving shaft 143 of DC motor 142 is operatively connected to a first pulley 144 which is operatively connected to a second pulley 146 through a belt 145.

Second pulley 146 has a groove for belt 145 and gear teeth formed separately and a flexible plastic string 148 is wound on the gear teeth. A train of teeth are formed on flexible string 148 to mesh with the gear teeth. Flexible string 148 has a flexibility suitable for being forced to expand and withdraw telescopic pipe 136.

Flexible string 148 extends within, through a hole 150 formed to casing 140, an inner telescopic pipe 152 which is coaxially installed inside telescopic pipe 136 and has the top end fixed to casing 140. The end of flexible string 148 is fixed to the lower end of inner pipe 152 which is fixed to the lower end of telescopic pipe 136.

The lowest stage of telescopic pipe 136 is provided with a plurality of blow-out holes 154 to create air bubbles. Air conduit 132 extends through casing 140 and communicates with inside of telescopic pipe 136. A space between telescopic pipe 136 and inner pipe 152 serves as an air passage and the air flowing out of air conduit 132 blows into rotatable tub 124, sequentially passing through the space and blow-out holes 154.

An ozone generator 156 may be further installed between air pump 134 and driving means 138 in order to kill bacteria inhabiting the laundry articles. As a result, ozone is contained in air bubbles blowing into rotatable tub 124 to remove bacteria from the laundry articles.

Moreover, a heater 158 may be installed between ozone generator 156 and driving means 138 in order to create a hot air stream for drying the laundry articles. The air stream generated from air pump 134 flows through air conduit 132 to heater 158 to heat up and is transmitted to the laundry articles within rotatable tub 124.

In this embodiment, ozone generator 156 and heater 158 are installed at one air conduit 132, but separate air conduits are utilized. That is, air pump 134 is utilized only to feed ozone to rotatable tub 124, and a fan may be further installed in order to feed air bubbles to rotatable tub 124. In this case, heater 158 is installed at the downstream of the fan and an air stream generated from the fan is provided within telescopic pipe 136 through a separate air conduit. Only fan is actuated to create air bubbles and both fan and heater 158 are actuated to dry the laundry articles.

Hereinafter, the operation of bubble washing machine according to the present invention will be described.

Prior to a washing process, a pseudo-dehydrating process proceeds during a predetermined period to ensure, within rotatable tub 124, a space for expanding telescopic pipe 136. After the pseudo-dehydrating process is completed, a forward drive signal is outputted from a microprocessor not shown in the drawings, so that DC motor 142 is forward rotated. Transmitted through first pulley 144 and belt 145, the rotating force is provided for second pulley 146. When second pulley 146 is rotated, flexible string 148 wound on second pulley 146 pushes down inner pipe 152 to expand telescopic pipe 136. When telescopic pipe 136 is expanded completely as shown in FIG. 2, the actuation of DC motor 142 is stopped and the washing machine operates along the selected courses.

In the washing process, when the washing fluid reaches a predetermined level, air pump 134 is actuated to feed air bubbles into rotatable tub 124 and pulsator 126 is rotated forward and reversely to wash the laundry articles. As pulsator 126 is rotated, the detergent is dissolved in washing fluid and stains are removed from the laundry articles. In this manner, the washing process is initiated and proceeded for a predetermined time period.

When the washing process is completed, a rinsing process is initiated. In the rinsing process, telescopic pipe 136 is kept expanded to feed air bubbles into rotatable tub 124 and pulsator 126 is rotated forward and reversely to rinse the laundry articles.

In the washing process and/or the rinsing process, ozone generator 156 operates continually or recurrently to kill bacteria inhabiting the laundry articles.

When the rinsing process is completed, a dehydrating process is initiated. In the dehydrating process, telescopic pipe 136 may be kept expanded or withdrawn.

When the dehydrating process is completed, a dry process is initiated. In the dry process, telescopic pipe 136 is kept expanded and heater 158 operates to supply a hot air stream to the laundry articles.

When the dry process is completed, a reverse drive signal is outputted from a microprocessor not shown in the drawings, so that DC motor 142 is reversely rotated. The rotation of DC motor 142 causes the ascent of telescopic pipe 136, and if it ascends completely, the operation of DC motor 142 is stopped.

As described above, in the washing machine according to the present invention, air bubbles blow out along a length of a rotation axis of the rotatable tub, so that the air bubbles can be uniformly distributed to the laundry articles.

Further, because the ozone generator is installed, the washing machine according to the present invention enables killing of bacteria inhabiting the laundry articles as well as cleaning them.

Moreover, the washing machine according to the present invention has the enhanced dry efficiency by way of uniformly feeding a hot air stream to the overall laundry articles.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A washing machine, comprising:

a stationary washer tub capable of containing a level of washing fluid;

a rotatable washer tub for receiving laundry articles, said rotatable washer tub having a plurality of fluid communication holes formed at its side wall and installed within said stationary washer tub;

a pulsator rotatably mounted on the bottom of said rotatable washer tub for creating a vortex flow therein;

drive means for generating the force for driving said rotatable washer tub and said pulsator;

expansible bubble feeding means installed at, toward said rotatable washer tub, a door provided for the top of a washer body, said bubble feeding means being expanded into said rotatable washer tub if the feeding of air bubbles is required for said rotatable washer tub and being withdrawn out of said rotatable washer tub if the feeding thereof is not required; and pneumatic generating means connected to said bubble feeding means through an air conduit for supplying air to said bubble feeding means.

2. The washing machine as claimed in claim 1, wherein said bubble feeding means comprises a telescopic pipe coaxially installed at said rotatable washer tub and capable of expanding axially, and pipe drive means for driving said telescopic pipe.

3. The washing machine as claimed in claim 2, wherein said telescopic pipe is provided with, at its lowest stage, a plurality of blow-out holes through which an air stream is fed into said rotatable washer tub to create air bubbles.

4. The washing machine as claimed in claim 2, wherein said telescopic pipe is a 3-stage telescopic pipe.

5. The washing machine as claimed in claim 2, wherein said pipe drive means comprises:

a motor for generating the driving force to expand/withdraw said telescopic pipe;

a first pulley operatively connected with said motor;

a second pulley having, at its outer circumference, a groove for a belt and gear teeth and operatively connected with said first pulley through the belt;

an inner telescopic pipe coaxially installed within said telescopic pipe, a lower end of said inner telescopic pipe being fixed to a lower end of said telescopic pipe; and a flexible string having a train of teeth meshed with said gear teeth, wound on said second pulley to mesh with said gear teeth and extending through said inner telescopic pipe to fix an end thereof to the lower end of said inner telescopic pipe.

6. The washing machine as claimed in claim 5, wherein said air conduit is communicated with the inside of said telescopic pipe so that an air stream flows from said air conduit through a space between said telescopic pipe and said inner telescopic pipe and blows out into said rotatable washer tub through said blow-out holes to create air bubbles.

7. The washing machine as claimed in claim 1, further comprising an ozone generator installed at the downstream of said pneumatic generating means for generating ozone to kill bacteria inhabiting the laundry articles, and wherein said pneumatic generating means is an air pump.

8. The washing machine as claimed in claim 7, further comprising a heater installed at the downstream of said ozone generator for creating heat to dry the laundry articles.

9. The washing machine as claimed in claim 1, further comprising a heater installed at the downstream of said pneumatic generating means for creating heat to dry the laundry articles, and wherein said pneumatic generating means is a fan.

10. The washing machine as claimed in claim 9, further comprising an air pump, an ozone generator communicating with said air pump for generating ozone to kill bacteria inhabiting the laundry articles and an ozone conduit extending from said ozone generator into said bubble feeding means for feeding ozone into said rotatable washer tub.

* * * * *